US005390596A

United States Patent [19]

Farr

[11] Patent Number: 5,390,596

[45] Date of Patent: Feb. 21, 1995

[54] STRETCHING SYSTEM FOR FLEXIBLE PLANAR MATERIALS

[76] Inventor: Gregory C. Farr, 4444 - 39th Ave., NE., Salem, Oreg. 97305

[21] Appl. No.: 818,545

[22] Filed: Jan. 6, 1992

[51] Int. Cl.[6] ..... B41M 1/12; B05C 17/06

[52] U.S. Cl. ..... 101/129; 101/127.1; 101/127

[58] Field of Search ..... 101/127, 127.1, 128, 101/128.21, 129; 38/102, 102.1, 102.2, 102.3, 102.4, 102.5, 102.6, 102.7, 102.8, 102.9, 102.91; 69/19, 19.3; 140/107, 108, 109; 160/378; 40/152, 155, 156

[56] References Cited

U.S. PATENT DOCUMENTS

| | | | |
|---|---|---|---|
| 1,618,361 | 2/1927 | Whitmore | 101/127.1 |
| 1,685,689 | 9/1928 | Stewart | 38/102.1 |
| 2,042,874 | 6/1936 | Acker | 38/102.4 |
| 2,185,441 | 1/1940 | Jureczki | 69/19.3 X |
| 2,455,640 | 12/1948 | Ashbaugh | 38/102.4 |
| 2,566,919 | 9/1951 | Black et al. | 101/127.1 X |
| 2,604,725 | 7/1952 | Jungjohann | 38/102.4 |
| 2,752,630 | 7/1956 | Taylor | 38/102.4 |
| 2,903,967 | 9/1959 | Levin | 101/127.1 |
| 3,176,843 | 4/1965 | Hoskins et al. | 101/127.1 |
| 3,230,872 | 1/1966 | DeGroot | 101/127.1 |
| 3,305,428 | 2/1967 | Moore et al. | 38/102.1 X |
| 3,381,820 | 5/1968 | Cecka | 101/127.1 X |
| 3,391,635 | 7/1968 | Matheus | 69/19.3 X |
| 3,414,994 | 12/1968 | Jaccard et al. | 101/127.1 X |
| 3,477,574 | 11/1969 | Malfroy | 209/403 |
| 3,762,080 | 10/1973 | Poole | 38/102.91 |
| 3,863,368 | 2/1975 | Vasilantone | 38/102.5 |
| 3,991,677 | 11/1976 | Barnes | 101/127.1 |
| 4,129,076 | 12/1978 | Gardner | 101/127.1 X |
| 4,144,660 | 3/1979 | Lamb | 38/102.5 |
| 4,190,974 | 3/1980 | Siler | 38/102.9 |
| 4,357,869 | 11/1982 | Wadstein | 101/127.1 |
| 4,452,138 | 6/1984 | Bubley et al. | 101/127.1 |
| 4,702,783 | 10/1987 | Mason, III | 101/128.1 X |
| 4,905,592 | 3/1990 | Sorel | 101/123 |

FOREIGN PATENT DOCUMENTS

| | | | |
|---|---|---|---|
| 0408449 | 3/1910 | France | 101/128 |
| 0102769 | 6/1983 | Japan | 101/128.1 |
| 0046648 | 2/1987 | Japan | 101/127 |

OTHER PUBLICATIONS

*Screen Printing Products;* Uncommon Conglomerates, Inc.

*Easy Sheet ABC*020189; ABC Extrusion Company.

*Precision Your Single Source;* Precision Screen Machines, Inc.

*Primary Examiner*—Edgar S. Burr

*Assistant Examiner*—Christopher A. Bennett

*Attorney, Agent, or Firm*—Klarquist Sparkman Campbell Leigh & Whinston

[57] ABSTRACT

A frame is disclosed for stretching a printing screen quickly and with uniform application of tension to the screen. The frame includes a base portion that defines a stretching plane in which the workpiece is stretched. A swingable portion of the frame pivots relative to the base and moves from a relaxed position in which the swingable portion defines a plane that intersects the stretching plane, to a stretching position in which the swingable portion is fixed in the stretching plane. A retainer secures the edges of the screen to the frame such that the screen mesh is uniformly stretched as the swingable portion is pushed into the stretching plane. A tension cable extends through the frame over a series of pulleys spaced several locations through each leg of the frame. Increased tension on the cable pulls the swingable portion of the frame into the stretching plane and holds the frame in that position to maintain tension on the screen. The screen itself has arcuate edges that curve to reduce the width and length of the screen toward the center of the screen. The peripheral margins of the screen are adhered to the retainers such that each arcuate edge conforms to the longitudinal axis of the retainer on which it is mounted. This linear adhesion of the arcuate edges helps ensure that the greatest amount of stretching occurs at the center region of the screen, which might otherwise tend to sag.

36 Claims, 8 Drawing Sheets

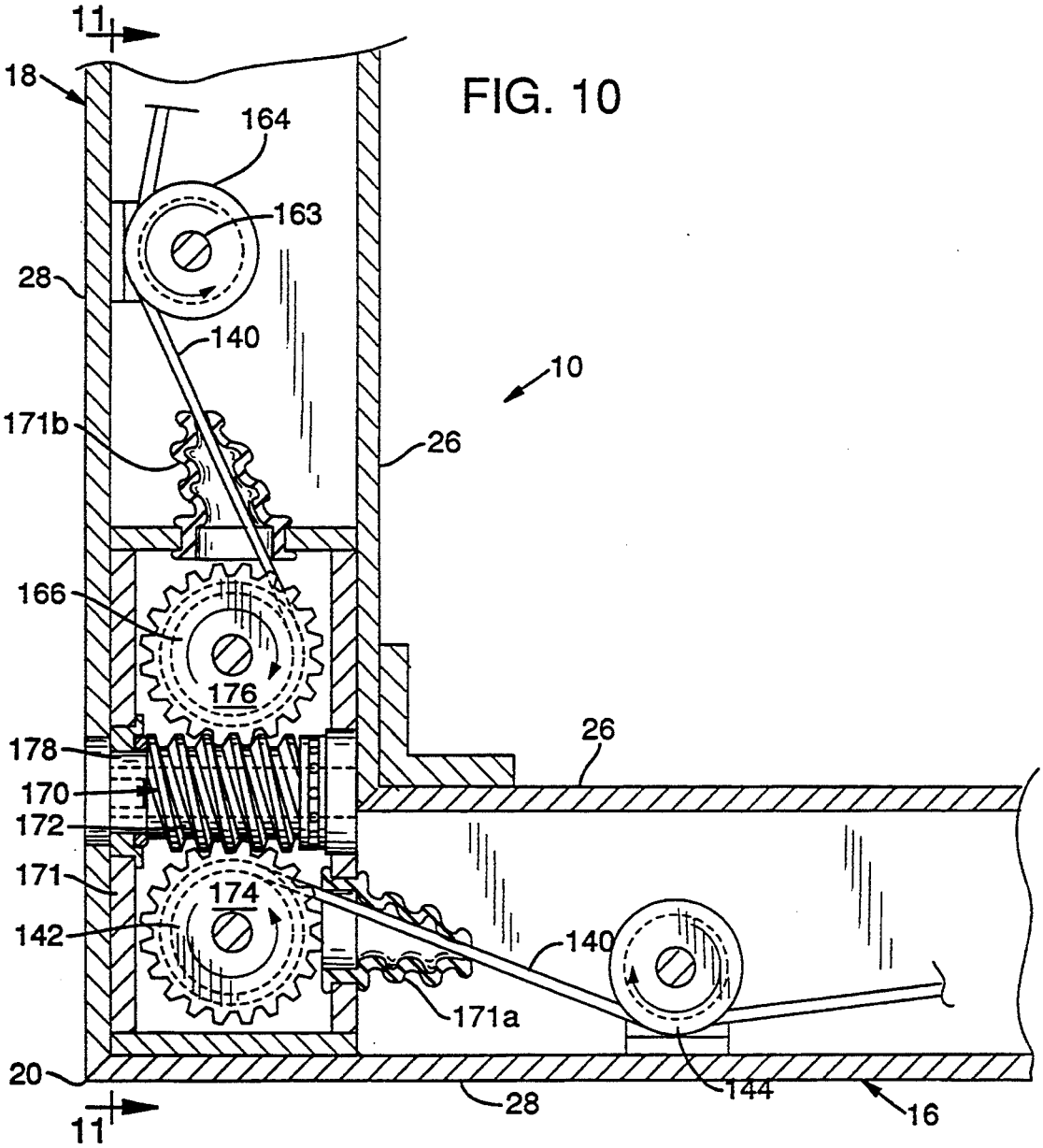
FIG. 10
FIG. 11
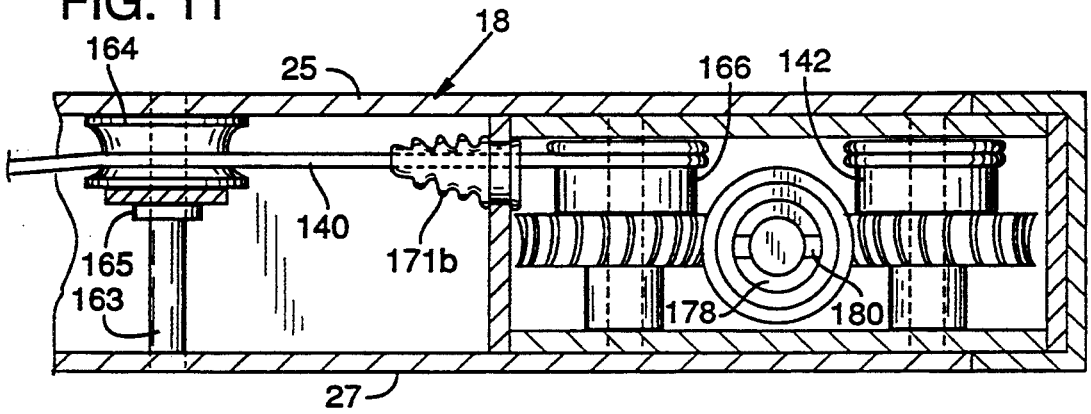

STRETCHING SYSTEM FOR FLEXIBLE PLANAR MATERIALS

BACKGROUND OF INVENTION

The present invention concerns methods and apparatus for stretching planar workpieces, and more particularly an improved system for stretching a printing screen.

In many instances, it is important to be able to quickly stretch a sheet of planar material to a desired tension or desired dimensions. For example, screen printing requires that a mesh screen of metal or fabric be uniformly stretched under very high tension while ink is applied through the mesh of the screen. Uniform tension on all parts of the screen is critical to ensure uniform distribution of ink through the screen and to produce a high quality image. To achieve uniform tension on the screen, prior devices have applied clamps to the edges of a screen at discrete spaced locations. The clamps are then pulled outwardly to exert tension on the screen in all directions until the screen is taut.

Very high tensile forces must be applied through the clamps to the screen to achieve tension of a sufficient magnitude in such devices. Rapid stretching of the screen by the clamps can, however, exceed the tensile strength of a screen and damage the integrity of the mesh. Hence, prior screen printing processes have required that the screen be stretched very slowly, often over many hours. This delay in screen stretching impairs printing efficiency and increases the cost of screen printing processes.

Several frames are known for holding mesh screens used in screen printing processes. U.S. Pat. No. 2,903,967; U.S. Pat. No. 3,863,368; U.S. Pat. No. 3,477,574; U.S. Pat. No. 3,762,080; U.S. Pat. No. 4,452,138; and U.S. Pat. No. 4,702,783 disclose planar frames that exert tension in the plane of the frame to stretch a screen taut. U.S. Pat. No. 4,144,660 and U.S. Pat. No. 4,190,974 also disclose planar frames for stretching a workpiece, such as an artist's canvas. U.S. Pat. No. 2,752,630 describes a star-shaped, planar tensilizer for stretching thermoplastic films. Finally, U.S. Pat. No. 2,042,874; U.S. Pat. No. 2,455,640; and U.S. Pat. No. 2,604,725 disclose planar frames for stretching curtains.

Such devices have many uses. But, all such devices have drawbacks which limit their usefulness for precision work, such as stretching mesh screens for use in printing. In particular, many of the prior devices require a highly trained worker to complete the installation over a long period of time. With prior screen printing equipment, for example, it typically takes hours to gradually tension a screen. And, even skilled workers are prone to damage printing screens. Other of the devices are too imprecise to be useful.

Accordingly, it is an object of this invention to provide an improved frame for quickly and efficiently stretching a planar workpiece, such as a mesh screen.

It is another object of the invention to provide such an improved frame that uniformly applies tension to the workpiece.

Also, it is an object of the invention to provide a stretching system that requires only minimal training to use.

A further object is to provide modular workpieces, particularly printing screens, that can be repeatedly installed and removed from a frame.

More specifically, it is an object to provide workpieces that can be repeatedly installed at the same position and tension.

These and other objects of the invention will be understood more clearly by reference to the following detailed description and drawings.

SUMMARY OF THE INVENTION

The foregoing objects are achieved by providing a frame for stretching a planar workpiece, such as a printing screen. The frame includes a base portion that defines a stretching plane in which the workpiece is stretched. A swingable portion of the frame pivots relative to the base and moves from a relaxed position in which the swingable portion defines a plane that intersects the stretching plane at an angle, to a stretching position in which the swingable portion is fixed in the stretching plane. A retainer secures the edges of the screen to the frame such that the mesh is uniformly stretched as the swingable portion is pushed into the stretching plane.

In preferred embodiments the frame is rectangular, and the base and swingable portions are each a right angle shaped frame member. Each frame member has a first leg and a second leg joined at a fixed mitered corner. The first legs of the frame member have distal ends that are pivotally joined by a hinge at a common mitered mating junction. The distal ends of the second legs are similarly joined pivotally by a hinge at a common mitered mating junction. Each hinge includes a pivot attachment between the hinge and one of the legs such that the swingable portion of the frame is free to rotate about an axis of one of the legs as the swingable portion moves out of the stretching plane.

The frame further includes a lock that selectively retains the swingable portion in the stretching plane. The lock is preferably a tension member that pulls the swingable portion toward the stretching plane. In especially preferred embodiments, the lock is a tension cable reeved over a series of pulleys spaced at several locations through each leg of the frame. Increased tension on the cable pulls the swingable portion of the frame into the stretching plane and holds the frame in place to maintain tension on the workpiece.

A workpiece according to the invention includes a retainer that holds the screen to a frame. The retainer includes four elongated connectors each having a workpiece retaining portion and a frame engaging portion. The workpiece retaining portion is an elongated planar member to which a peripheral border of the workpiece can be adhered. The frame engaging portion is preferably an L-shaped member that extends over the outside face of each leg of the frame and into a slot on the outside face of the leg. The workpiece preferably comprises a four-sided sheet having edges that, when not tensioned, are arcuate and curved so that the width and length of the sheet are less at the center of the screen than at the corners. This shape ensures that the greatest amount of outward force is applied to the center portion of the screen, which might otherwise tend to sag, when the frame is in its stretching position.

BRIEF DESCRIPTION OF THE DRAWINGS

FIG. 10 is an enlarged, fragmentary, sectional view taken along line 9—9 of FIG. 4, showing a tightener for the tensioning device.

FIG. 11 is a fragmentary, sectional view taken along line 11—11 of FIG. 10.

DETAILED DESCRIPTION

Figure 1:
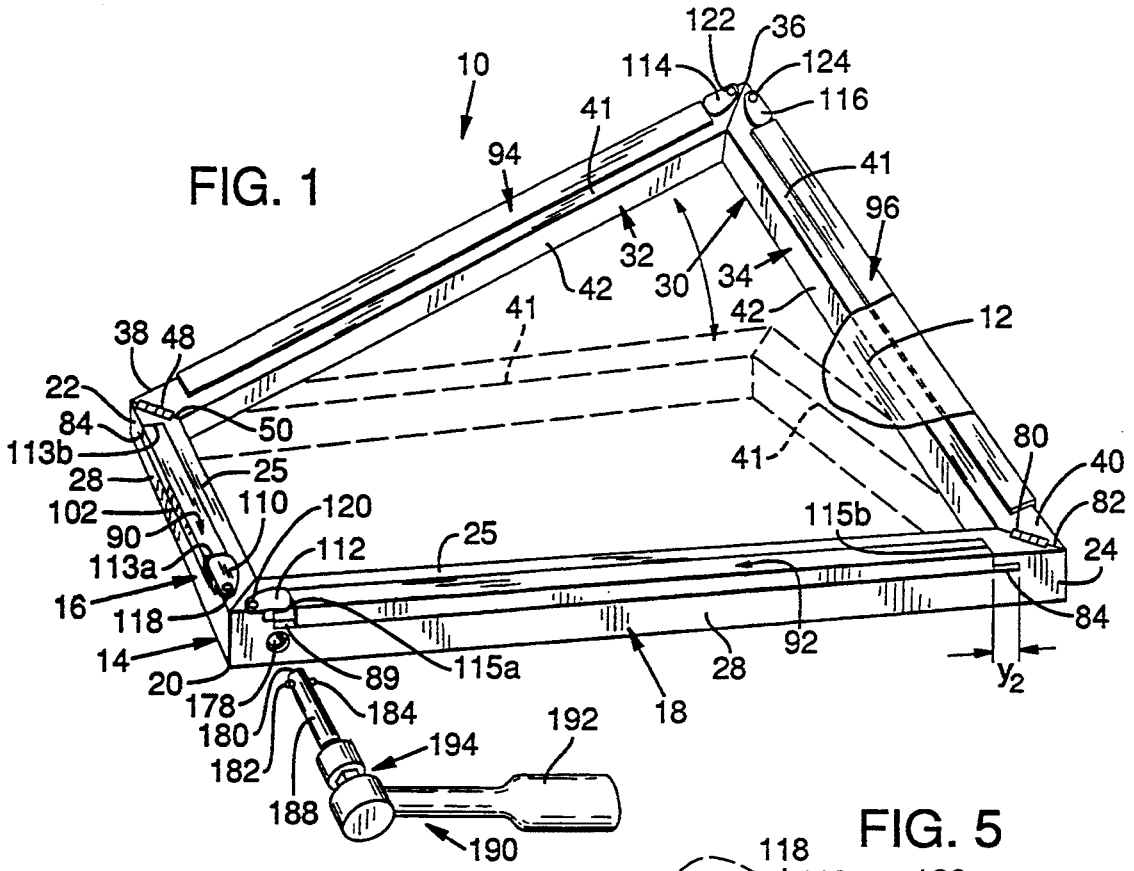
FIG. 1 is a top, perspective view of the frame of the present invention shown in its relaxed position, the stretching position of the swingable portion of the frame being shown in phantom.

A rectangular frame 10 is shown in FIG. 1 for stretching a four-sided planar workpiece, such as printing screen 12 (FIG. 2) having edges 12*a*, 12*b*, 12*c*, 12*d* and corners 13*a*, 13*b*, 13*c*, 13*d*.

The quadrilateral frame 10 includes a right angle shaped base or stationary portion 14 that includes first and second legs 16, 18 perpendicularly joined at a mitered corner 20 and terminating in first and second distal ends 22, 24. Each leg 16, 18 has an upper face 25 (FIGS. 1 and 4), inner face 26, bottom face 27, and outer face 28. Upper faces 25 of legs 16, 18 of base portion 14 define a stretching plane P parallel to which screen 12 is stretched.

Figure 6:
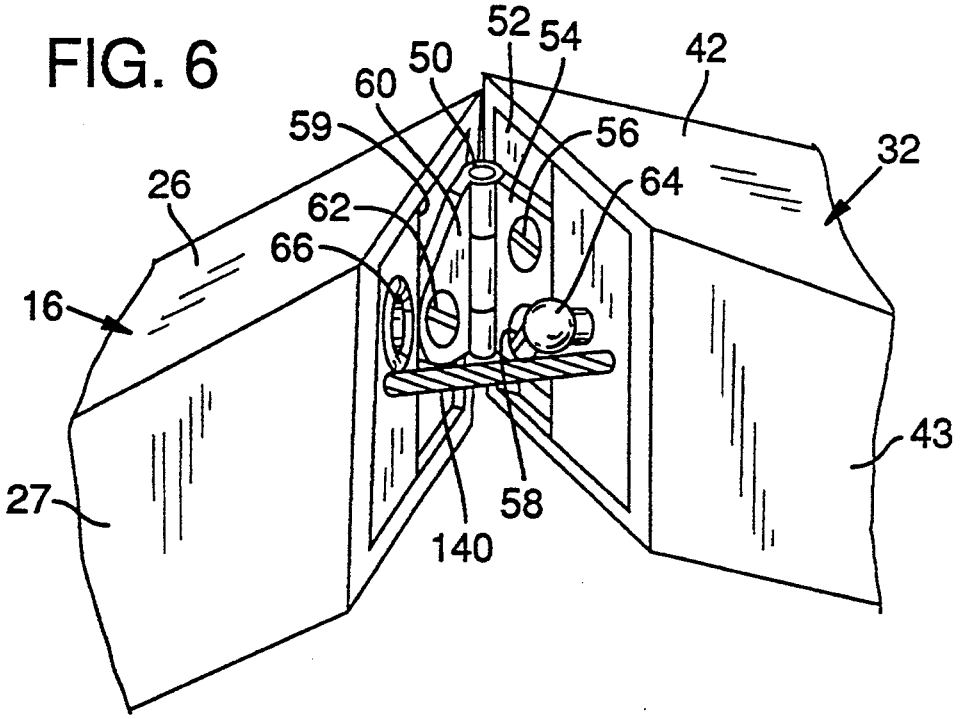
FIG. 6 is an enlarged, bottom, oblique view of a hinged corner of the frame shown in FIG. 1.
Figure 8:
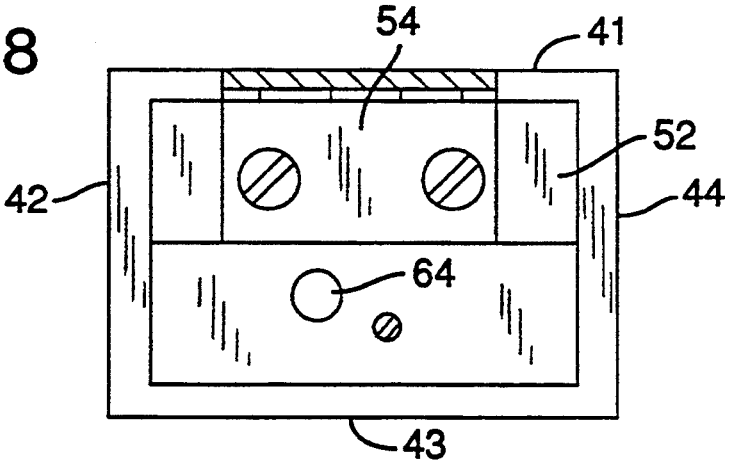
FIG. 8 is an end, elevational view of the end face of a stationary leg of the frame shown in FIG. 6.

Frame 10 also includes a right angle shaped swingable portion 30 having first and second legs 32, 34 joined at a common mitered corner 36 and terminating in first and second distal ends 38, 40. Each leg 32, 34 has an upper face 41 and inner face 42 (FIG. 1), and bottom face 43 and an outer face 44 (FIGS. 6 and 8). Swingable portion 30 pivots relative to base portion 14 and moves from a relaxed or retracted position (shown in solid lines in FIG. 1) to a stretching position (shown in phantom in FIG. 1). In a fully relaxed position, the upper faces 41 of swingable portion 30 define a plane that intersects the stretching plane at an angle of about 90 to 150 degrees. In the stretching position, however, the upper faces 41 of swingable portion 30 define a plane that is substantially co-planar with the upper faces 25 of base portion 14 and that extends parallel to the stretching plane P.

Swingable portion 30 pivots about a pair of aligned hinged connections between the swingable portion 30 and base portion 14. A first hinge connector 48 connects the first ends 22, 38 of the base portion 14 and swingable portion 30 along a mitered junction 50. When the swingable portion 30 is in the stretching position, the pin of hinge 48 extends in the plane of faces 25. Hinge 48 further includes a pivot attachment that allows the first leg 32 of the swingable portion to rotate as the leg 32 moves up out of the stretching position.

Figure 7:
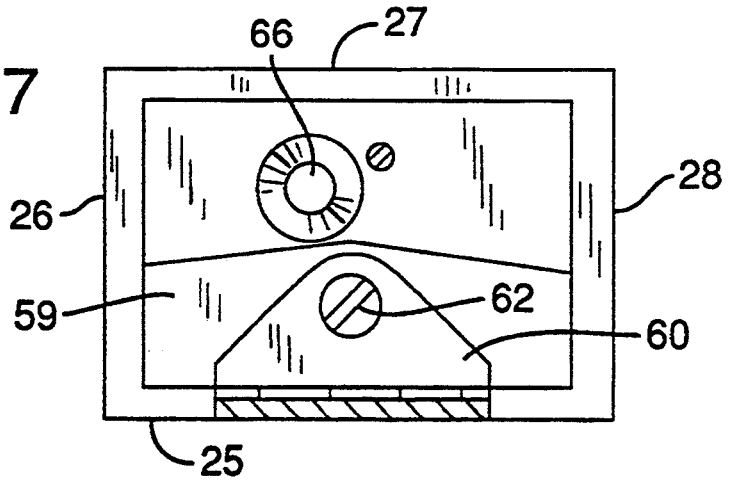
FIG. 7 is an end, elevational view of the hinged face of a swingable leg of the frame shown in FIG. 6.

Hinge connector 48 is shown in greater detail in FIGS. 6–8 to include a tubular hinge barrel 50 that is formed by interdigitating knuckles of a pair of hinge leaves. One knuckle of the barrel is secured to an end face 52 of leg 32 by a stationary hinge leaf plate 54. The plate 54 is fixed to face 52 by screws 56, 58. The other leaf 60 of hinge 48 is a pivot leaf plate that is rotatably secured to an end face 59 of leg 16 by a pivot screw 62 which has a longitudinal axis extending through the leg 16. Because the leaf 60 and leg 32 can rotate about the longitudinal axis of the screw 62, the leg 32 swings out of its position parallel to the stretching plane P as the leg 32 moves into a relaxed position. A dowel pin 64 protrudes outwardly from the end face of first leg 32 to serve as a guide member. The pin 64 is positioned to fit into a cylindrical or spherical guide socket 66 in the end face of first leg 16 for guiding legs 16, 32 into proper alignment.

A second hinge connector 80 (FIG. 1) connects the second ends 24, 40 of the base and swingable portions 14, 30. When the swingable portion 30 is in the stretching position, the pin of hinge connector 80 extends in the plane of faces 25 along a mitered junction 82 between ends 24, 40. The hinge connector 80 further includes a pivot attachment (not shown) to the second end 24 of the base portion 14. The pivot attachment allows the leg 34 of the swingable portion 30 to rotate about an axis of the pivot attachment. Hinge connector 80 is similar to hinge connector 48 and pivot leaves 54, 60 that are shown and described in connection with FIGS. 6–8.

Each leg includes a device to engage the workpiece. In particular, an elongated linear slot 84 (FIGS. 1 and 4) is provided through the outer face 28 or 44 of each leg 16, 18, 32, 34 of the frame and extends partially along the length of each leg. Each slot 84 has flat parallel top and bottom surfaces 86, 87 that are substantially parallel to the top face 25 or 41 of the leg in which the slot is placed. In the embodiment of FIG. 1, each slot through the outside face terminates near each mitered corner at a position slightly short of the mitered junction. Slot 84 in leg 16, for example, terminates adjacent mitered corner 20 at a wall 88 (FIGS. 1 and 5), and slot 84 in leg 18 terminates adjacent corner 20 at a wall 89 (FIG. 5).

Four elongate retainers 90, 92, 94, 96 are provided to hold a screen on the frame. The retainers are attached to the screen along the perimeter of a geometric Figure, most efficiently a Figure that is generally in the shape of a rectangle. When the illustrated screen is stretched on the frame, the Figure has a longitudinal centerline $C_1$ that extends parallel to and is equidistant from the retainers 92, 94 and a lateral centerline $C_2$ that extends parallel to and is equidistant from retainers 90, 96.

Each retainer secures an edge of the illustrated screen to the frame by hooking into one of the slots. In the embodiment of FIG. 1, the slots 84 are longer than the retainers such that, after installation of a screen is complete, there is a gap between each end of each retainer and the ends of the slot which contains that retainer. Although the retainers would be automatically self-aligning if the retainers were the same length as the slots, this is not preferred. It would be difficult or impossible to install the retainers in the slots if there were no leeway.

Figure 4:
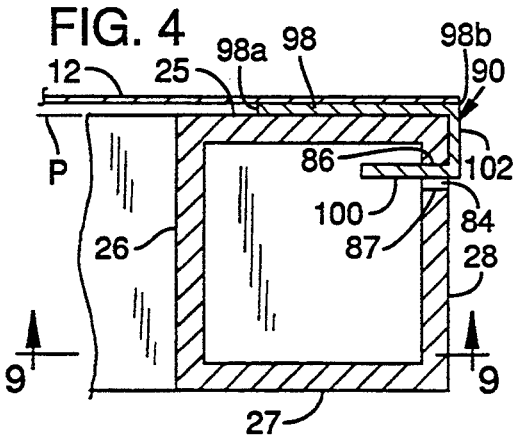
FIG. 4 is an enlarged, fragmentary, sectional view taken along line 4—4 of FIG. 3 showing the screen secured to a retainer, which is in turn hooked to the frame. Internal detail of the frame mechanism is omitted.
Figure 5:
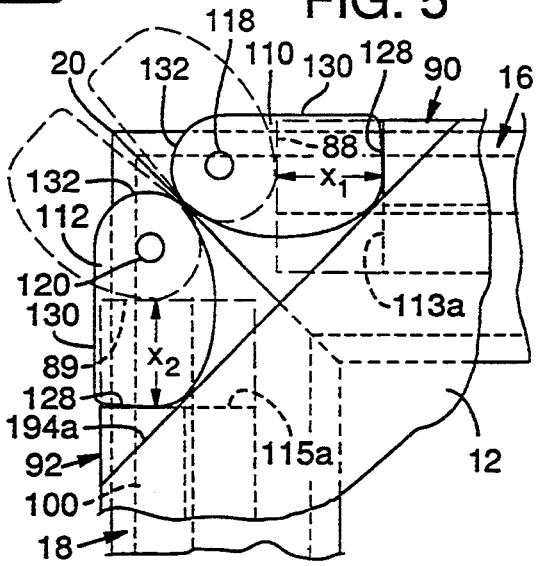
FIG. 5 is an enlarged, top, plan view of a corner of the frame showing spacers for inhibiting movement of the retainers, retracted positions of the spacers being shown in phantom.

Each retainer, as illustrated by retainer 90 in FIG. 4, is a J-shaped member having a first planar screen retaining member or flange 98 for securing an edge of the screen to the retainer, and a spaced second planar member or flange 100 that fits into one of the slots 84 in the outer faces of the frame. The first and second planar members 98, 100 are connected by a spacer or web 102 that is perpendicular to members 98, 100 and is sufficiently high to allow member 98 to rest on the top face of the frame, yet allow member 100 to insert into the slot 84. Hence, the distance between members 98, 100 is about the same as the distance between the plane of the top face 25 and the slot 84. The member 100 and spacer 102 together comprise an L-shaped hook.

For workpieces to be reused or interchanged, an alignment device is provided so that workpieces can be mounted at a predictable location on a given frame.

In the embodiment of FIG. 1, four spacers 110, 112, 114, 116 are each mounted on pivot pins 118, 120, 122, 124, respectively, to position the retainers and to inhibit the retainers from longitudinally sliding in slots 84. Spacers are mounted on opposite sides of each fixed corner that does not have a hinge, such as mitered corner 20 that joins legs 16, 19 (FIGS. 1 and 5). Each spacer is a flat member having a straight edge 128 that abuts against the terminal edge of an adjacent retainer.

The edges 128 of spacers 110, 112, respectively, abut edges 113*a*, 115*a* of the screen retaining member of the retainers 90, 92 when the screen is installed and tensioned. The spacers 110, 112 also have a straight edge 130 that is substantially aligned with, or parallel to, the outer edge of the frame when the spacers are in the spacing position shown in solid lines in FIG. 5. Stops (not shown) can be provided to limit the arc through which the spacers 110, 112 can swing.

Each spacer also has an end portion with arcuate edges 132 that form a portion of a circle. The arcuate edges 132 allow adjacent spacers 110, 112 to move without interference as the spacers are rotated around pivot pins 118, 120 from the active position shown in solid lines in FIG. 5 to a retracted position shown in phantom. In the retracted position of the spacers, straight edges 130 almost abut against one another to act as a stop against further movement. The length of each spacer 110, 112 is sufficient that it prevents movement of retainers 90, 92 toward mitered edge 20, and properly positions terminal edges 113*a*, 115*a* of the retainers with respect to the frame. In the embodiment of FIG. 1, those edges are spaced distances $x_1$, $x_2$ from the ends 88, 89 of slots 84. And, the ends 113*b*, 115*b* of retainers 90, 92 at the opposite ends of the slots are spaced distances $y_1$, $y_2$ from the end walls of the slots. In a preferred embodiment all the distances x and all the distances y are equal. But, it is possible to allow different distances at each end of each retainer.

Another pair of spacers 114, 116 is mounted on opposite sides of mitered corner 36 that joins legs 32, 34. Each spacer 114, 116 is identical to spacers 110, 112 and is sufficiently long to space each retainer 94, 96 distances $x_3$, $x_4$ (not shown) from the terminations of slots 84 adjacent corner 36. The retainers 94, 96, when installed with the screen tensioned are also thus spaced distances $y_3$, $y_4$ (not shown) from the terminations of slots 84 nearest the hinge assemblies 48, 80. Thus, in the embodiment illustrated in FIG. 1, the length of each slot 84 is equal to the length of the retainer in the slot plus the distance x and the distance y at the ends of the retainer.

Alternatively, the slots 84 could extend (not shown) all the way to the ends and corners 20, 22, 24, 36, 38, 40. And, grooves (not shown) could be provided instead of the slots 84.

The workpiece (e.g., screen) held by the retainers will be maintained stationary on the frame, at its optimal location, when all the spacers 90–96 are in the extended positions (shown in solid lines in FIG. 1) and are abutting adjacent retainers. Retainers 90, 96, for example, secure opposite edges of the workpiece. The retainers 90, 96 will not be inclined to move away from spacers 110, 116 because tension from the screen 12 urges the retainers toward the spacers. Screen tension similarly urges the retainers 92, 94 toward the spacers 112, 114. Even though workpieces thus tend to be self aligning, the installer can confirm proper alignment simply by observing whether a retainer abuts each edge 128 during installation of a workpiece.

Figure 9:
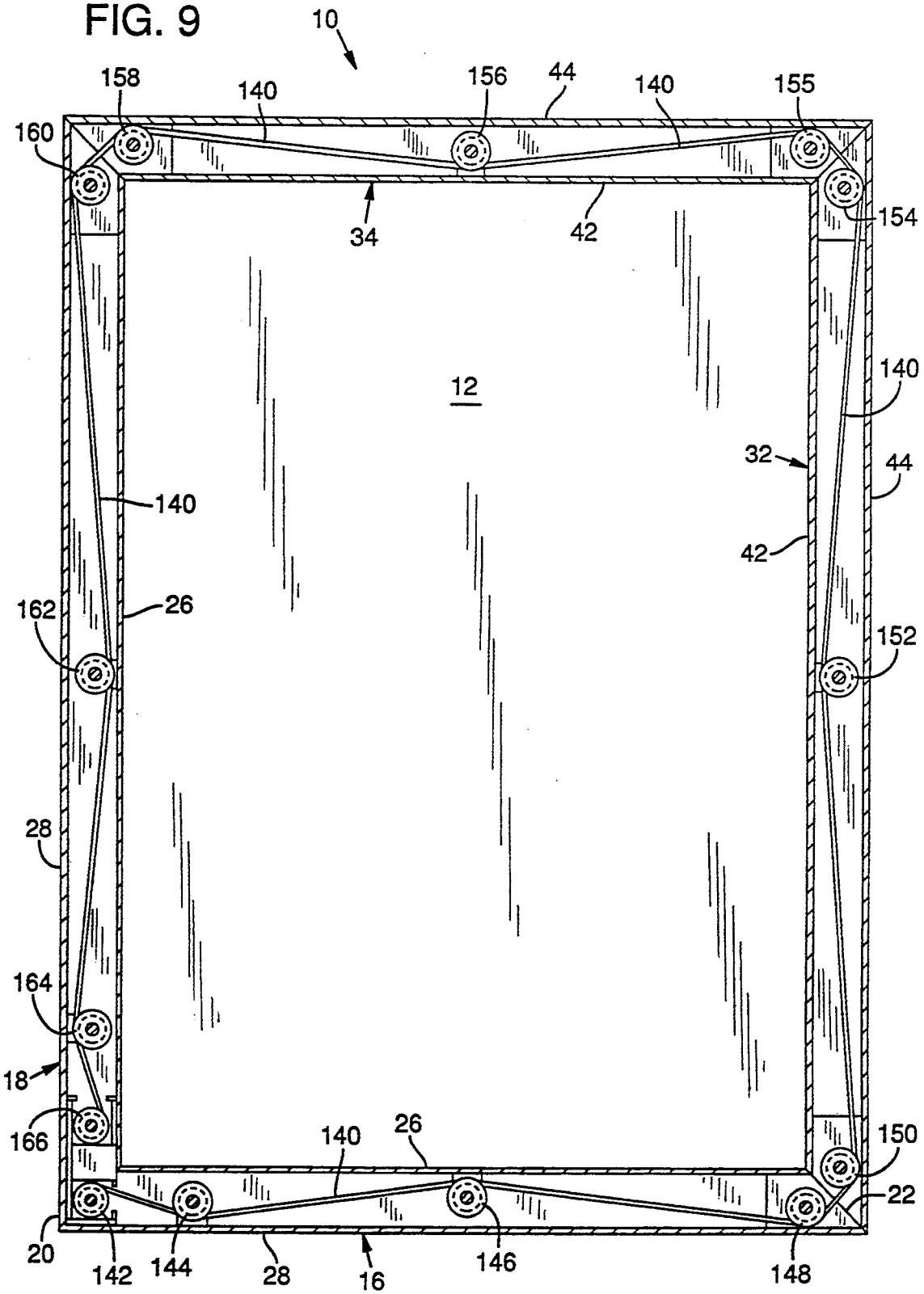
FIG. 9 is a reduced, schematic, sectional view taken along line 9—9 of FIG. 4, showing a tensioning device inside the frame.

Frame 10 is also provided with a lock mechanism (FIGS. 9–11) that maintains the swingable portion 30 of frame 10 in the stretching position. The lock mechanism is shown in FIGS. 9–11 to be a continuous cable 140 that extends through the frame. A series of pulley wheels 142, 144, 146, 148, 150, 152, 154, 155, 156, 158, 160, 162, 164 and 166 are mounted underneath the top face of frame 10 on shafts (such as shaft 163 in FIG. 11) that extend between the top and bottom faces of the frame and allow wheels 142–166 to rotate freely. The wheels are held against the top faces of the frame by an annular collar (such as collar 165 in FIG. 11) fixed around each shaft (such as shaft 163). Cable 140 is fixed at each end to pulleys 142, 166 (FIG. 11) such that rotation of pulleys 142, 166 winds cable 140 around pulleys 142, 166 and increases tension on the cable.

Each wheel is a sheave with a groove in which cable 140 rides. Pulley 142 is mounted in corner 20 underneath the mitered junction of top faces 25 where legs 16, 18 join. Wheels 144, 146 are mounted in leg 16 with wheel 146 near a midpoint of leg 16 and wheel 144 between wheels 142, 146. Wheel 144 peripherally abuts against outer face 28 of leg 16, while wheel 146 abuts against inner face 26. Wheels 148, 150 are positioned in corner 22 on either side of the mitered junction of legs 16, 32, with outer faces 28, 44 respectively abutting tangentially against wheels 148, 150. Wheel 152 is positioned beneath top face 41 at a midpoint of leg 32 tangentially to inner face 42, and wheel 154 is located near the mitered junction 36 abutting against the outer face 44 of leg 32. Wheel 155 is located within leg 34, near the mitered junction 36, tangential to the outer face 44. Wheel 156 is positioned at a midpoint of leg 34 against inner face 42, while wheels 158, 160 are at a mitered corner 82 on either side of hinge connector 80 and abutting against outer faces 28, 44. Wheel 162 is near a midpoint of leg 18 adjacent inner face 26, while wheel 166 is adjacent corner 20 and wheel 164 is between wheels 162, 164 in leg 18. Cable 140 is reeved around the groove in wheels 144–164 by alternating the cable around sides of the wheels such that the cable is between each of the wheels and the wall of the leg that abuts tangentially against the wheel. Hence the walls help hold the cable in place on the wheel.

The tightening mechanism for the wheel is a worm gear 170 shown in greater detail in FIGS. 10 and 11 at the junction of legs 16, 18. The worm gear sits in a housing 171 that reinforces corner 20 and includes a plastic grease retention member 171*a* projecting into leg 16 along the path of cable 140 toward wheel 144, and another plastic grease retention member 171*b* projecting into leg 18 along the path of cable 140 toward wheel 164. Each of wheels 142, 166 is a gear wheel with elongated arcuate teeth that engage a helical groove 172 on a barrel of the worm gear mechanism such that rotation of the barrel rotates wheel 142 in the direction of arrow 174 and wheel 166 in the direction of arrow 176. A key ring 178 is circumferentially secured against an outer face of the barrel and forms a key slot 180. The slot 180 mates with a pair of key pins 182, 184 (FIG. 1) that extend outwardly in opposite directions from a tip 186 of a shaft 188 of a tightening tool 190 that has a handle 192. Shaft 188 is connected at a right angle to handle 192 by a socket 194 that rotates shaft 186 when handle 192 is moved through an arc.

Figure 2:
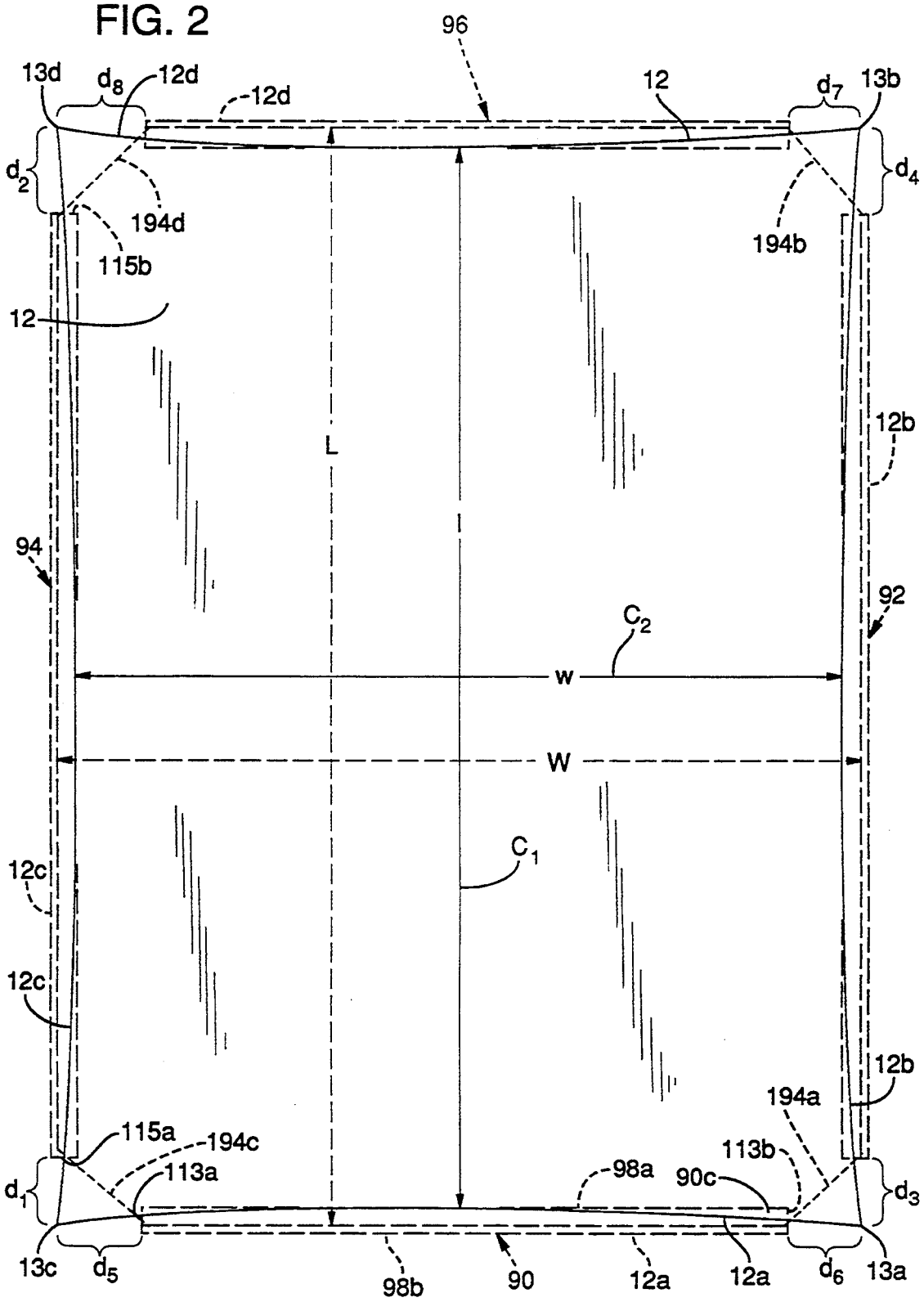
FIG. 2 is a schematic, top view of a relaxed screen before it is attached to retainers, the phantom lines showing the relationship of the screen to the retainers after the peripheral borders of the screen are adhered and the screen is tensioned on a frame.

FIG. 2 illustrates the configuration of certain workpieces according to the present invention. Shown is a relaxed printing screen 12 (solid lines in FIG. 2) that is a somewhat rectangular mesh printing screen having four edges including two lateral edges 12*a*, 12*d* and two longitudinal edges 12*b*, 12*c*, and four corners 13*a*, 13*b*, 13*c*, 13*d*. Each of the edges is arcuate such that the length and width of the screen tapers toward the center of the screen. Hence, inwardly of the corners, the width w of the relaxed screen 12 is less than the width W that the screen would have if it were truly rectangular. Similarly, inwardly of the corners, the length l of the relaxed screen is less than the length L that the screen would have if it were truly rectangular. Or, in other words, due to the arcuate shape of the edges, the width and length of the workpiece are less at the centerlines of the workpiece than at the outlying regions of the workpiece.

The arcuate shapes of the edges are chosen such that when longitudinal and lateral tensile forces are applied to the edges while the edges are held straight, the workpiece is uniformly tensioned. For the purpose of this disclosure, "uniformly tensioned" means that, when a tensioned workpiece is held horizontally and multiple tension (N/cm) measurements are taken at different points throughout the operative region of the workpiece, the measurements are substantially equal. In the particular case of printing screens, such uniformity of tension applies to that region where ink is transmitted through a screen.

To achieve interchangeability and reusability of screens, screen assemblies must behave predictably. Thus, for each screen, the distance between the inner surfaces of spacers 102 of opposed retainers must be carefully selected so that each screen stretched on a given frame will have the desired uniform tension across the entire operative region of the screen.

The centerline dimensions l, w can be determined by using a ratio X. By multiplying the dimensions L, W by the ratio X, one can determine the dimensions l, w for various sizes of the same fabric. The ratio X will vary somewhat depending on the type of material used for the workpiece, the flexibility of the frame on which it will be stretched, and possibly other factors. The best dimensions for a particular type of workpiece can be determined by experimentation. Direction for the experiments comes from the ratios established previously for other types of fabric and from information from fabric manufacturers on optimal tension. Although experimentation can require some time, it only need be performed once for a particular type of workpiece. Thereafter, additional workpiece-sized pieces of fabric can be quickly pre-cut prior to being attached to retainers.

In a preferred embodiment, a printing screen is made of 230 mesh PECAP polyester fabric. The fabric is cut to the dimensions L=20 inches and W=16 inches. The ratio X for this embodiment is 0.96, therefore, the centerline dimensions are cut to l=19.3 inches and w=15.4 inches. The fabric is thus stretched by about four percent along its centerlines during tensioning. The percentage of lateral and longitudinal stretching, as measured along lines that extend parallel to the center lines, decreases progressively from the centerlines to the fabric edges due to the scalloped shape of the edges. The 0.96 ratio is appropriate for a screen to be stretched on a frame, as illustrated in FIG. 1, constructed of $1\frac{1}{4}$ inch square aluminum stock having a wall thickness of $\frac{1}{8}$ inch. The retainers are positioned, parallel to the frame legs, at a spacing such that the tensioned fabric has substantially straight edges with the dimensions l=20.0 inches and w=16.0 inches and has a tension of 20 to 30 N/cm (newtons/deflection distance) across the entire operative region of the screen.

Multiple uniform workpieces can be obtained by cutting fabric to size using a pattern shaped as shown by the solid lines in FIG. 2. To insure proper dimensions, the fabric should first be ironed, if necessary to remove wrinkles. The relaxed fabric can then be cut to the desired, predetermined size.

The dimensions L, W are obtained by measuring a flat, relaxed workpiece from corner to corner. The measurements l, w are taken along longitudinal centerline $C_1$ and lateral centerline $C_2$ which are located midway between the corners. Most preferably, each edge of the fabric is a minor arc of a circle.

Another method of attaching fabric to retainers, though not preferred due to the inconsistencies it will produce in the operative region of the workpiece, is to start with an oversized piece of fabric and then stretch it to a desired tension pattern, using an oversized frame, the frame being of the type now commonly used in the screen printing art. A rectangle, in the desired dimensions of a tensioned workpiece, is then drawn on the oversized, tensioned fabric. The fabric is then removed from the oversized frame and cut along the edges of the rectangle that was drawn thereon. The result is a workpiece-sized piece of fabric with narrowed center portions, since at least the central dimensions of the fabric reduce when tension is released. Conveniently, the relaxed, workpiece-sized piece of fabric is traced to make a pattern. The pattern is then used for cutting additional workpiece-sized pieces of fabric from bolts of relaxed fabric of the same composition. Although use of a prior tensioning device is a slow step, it only needs to be performed once for a particular type of fabric. Thereafter, the additional workpiece-sized pieces of fabric are cut quickly, without tensioning the fabric, by using the pattern.

Another production method for attaching fabric to retainers, though again not preferred, also involves stretching an oversized piece of fabric on an oversized frame. In this method, four retainers are mounted on a jig (not shown) which holds them in the rectangular alignment of retainers for a fully stretched workpiece on a working-sized frame. While held by the jig, the retainers are glued or otherwise attached to the fabric while it is stretched on the oversized frame. Once tension applied by the oversized frame is released, excess fabric is trimmed from around the retainers, whereupon the resulting workpiece is ready for mounting on a working-sized frame. Although not preferred, multiple screens could be manufactured simultaneously by using a very large piece of fabric and stretching it on a very large frame so that multiple sets of retainers could be attached to the fabric at once. Then, after the tension is released, the fabric is trimmed to provide multiple workpieces with the retainers in place. It is possible to attach the retainers without using a jig, e.g., by simply measuring to position the retainers, but such is less convenient.

In the embodiment of FIG. 1, the peripheral borders of screen 12 were glued to the screen retaining member 98 of each retainer. Edge 12*a* was glued to retainer 90, edge 12*b* to retainer 92, edge 12*c* to retainer 94 and edge 12*d* to retainer 96. Each screen border edge was adhered in a straight line substantially parallel to the longitudinal free edge of the retainer with a rectangular area of overlap between the screen and retainer. The retainer 90, for example, has parallel front and back top edges 98*a*, 98*b* (FIGS. 2 and 4). Edge 12*a* of the screen was glued to the top surface of retainer plate 98, parallel to edges 98*a*, 98*b* and closer to edge 98*b* than 98*a*, such that a rectangular peripheral margin of the screen overlaps the retainer. Edges 12*b*, 12*c* and 12*d* were similarly adhered to retainers 92, 94, 96 with similar rectangular margins overlapping the retainers. If desired, the edges of the screen can further be extended around the retainers and glued to the spaces 102 (not shown) to increase the area of contact between the screen and the retainers. It is helpful for the retainers to be made of a material which is generally rigid, but sufficiently flexible that a retainer can be bent to the same arc as the edge of the fabric during gluing.

Adhering the curved edges of the screen 12 parallel to the edges of the retainers is an advantageous way to obtain uniform tension when the screen is stretched on the frame. Because the frame supports the retainers in straight and parallel orientations, the screen is stretched the greatest amount along the centerlines where the dimensions are the smallest when the screen is relaxed.

The edges of the screen are preferably permanently adhered to the respective retainers by a cyanoacrylate adhesive. U.S. Pat. No. 4,702,783, which is incorporated herein by reference, describes one such adhesive that has been used to attach fabric to a fixed frame. Other attachment methods can be used. For example, fabric could be heat bonded to the retainers; or a binding strip (not shown) could be used to attach the fabric mechanically, e.g., to sandwich a marginal region of the fabric between members secured with rivets or other fasteners.

In the illustrated embodiments, the length of each retainer is less than the length of the edge of the screen that is supported by the retainer. Retainer 94 (FIG. 2), for example, is adhered to edge 12*c* such that end 115*a* of the retainer is a distance $d_1$ from corner 13*c* and end 115*b* is a distance $d_2$ from corner 13*d*. Opposing retainer 92 is placed correspondingly on edge 12*b* with its ends a distance $d_3$ and $d_4$ from respective corners 13*a*, 13*b*. Retainer 90 is adhered to edge 12*a* with its end 113*a* spaced a distance $d_5$ from corner 13*c* and end 113*b* a distance $d_6$ from corner 13*a*. Retainer 96 is correspondingly adhered to edge 12*d* with its ends a distance $d_7$ from corner 13*b* and a distance $d_8$ from corner 13*d*. For convenience, the distances $d_1$–$d_8$ can all be equal; or all opposed pairs of distances ($d_1$ and $d_4$, $d_2$ and $d_3$, $d_5$ and $d_7$, and $d_6$ and $d_8$) can respectively be equal. By using such equalized spacings, a workpiece can be installed on a frame in either of two orientations. Unequal spacings can be used, but such is less convenient.

Figure 3:
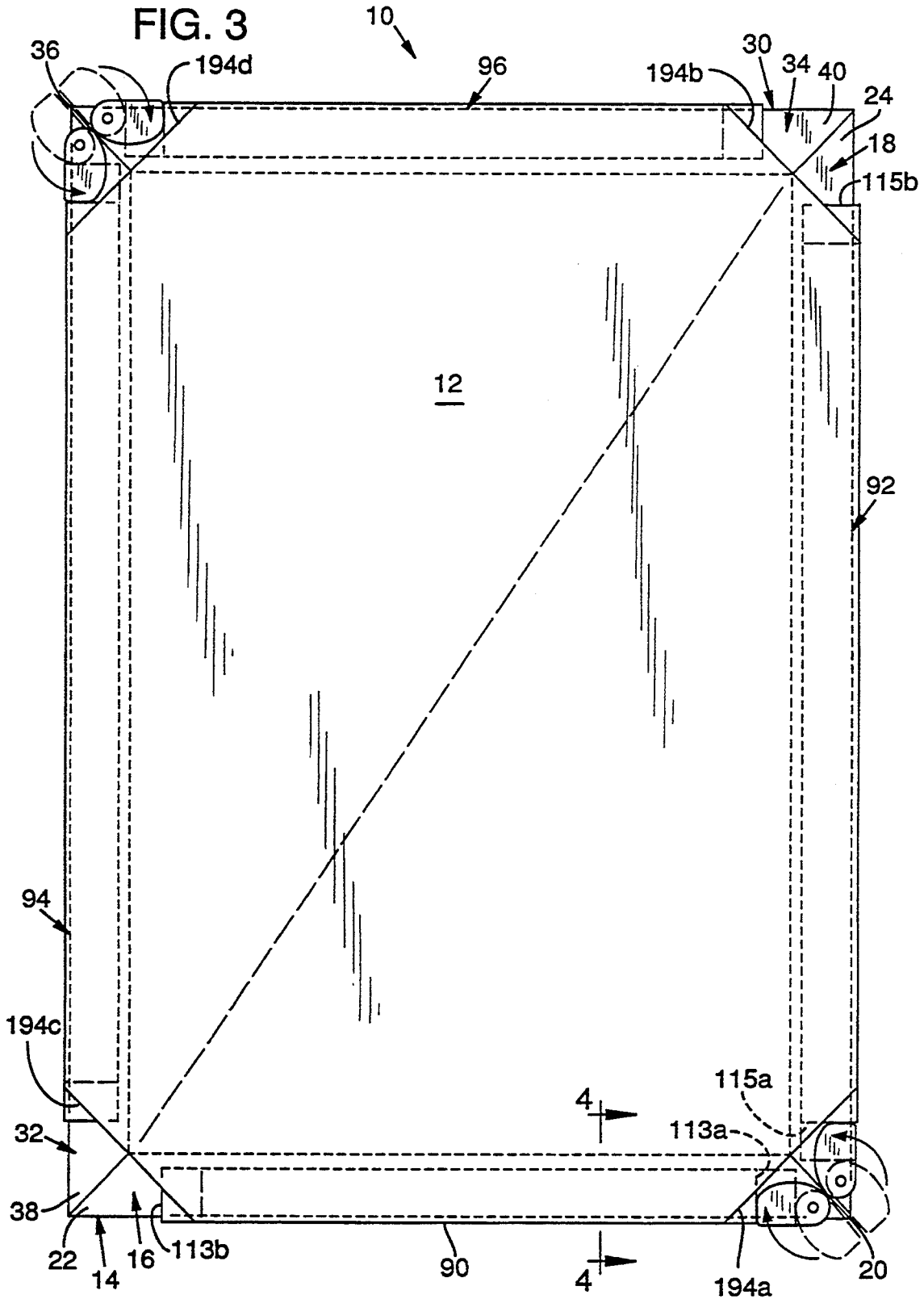
FIG. 3 is a top, plan view of the frame with the retainers in place on it, the folding axis of the frame being illustrated by a dashed line.

Once each edge of the screen is adhered to a retainer, the retainers are placed on the frame 10 while portion 30 is in its relaxed position shown in FIG. 1 and the spacers are in the retracted position shown in phantom in FIG. 3. Retainer 90 is placed in the slot in outer face 28 of leg 16 by inserting a hook member 100 into the slot 84. Retainer 92 is similarly inserted into the slot 84 through the outer face of leg 18, retainer 94 is inserted into the slot on leg 32, and retainer 96 is inserted into the slot on leg 34. Spacers 110, 112, 114 and 116 are then rotated from their retracted positions to the active positions shown in solid lines in FIG. 5. After the screen is held in place by the retainers on frame 10, the tip of corner 13*a* fits between spacers 110, 112, and the tip of corner 13d fits between spacers 114, 116.

As shown in FIGS. 2 and 3, corner regions of the workpiece may be folded back or cut off diagonally, e.g. along lines 194*a*, 194*b*, 194*c*, 194*d*. For the measurements described in this disclosure, distances between corners are measured between the corners that would have existed had corner regions not been folded back or cut off. I.e., corner to corner measurements are taken from the points where the arcuate edges would intersect if extended.

Once the retainers are in position abutting the spacers, swingable portion 30 of the frame is moved into the stretching position. This can most rapidly be accomplished by resting the base portion 14 on a surface, as shown in FIG. 1, while manually pushing downwardly on the swingable portion 30 at a location near the corner 36. The frame is locked in the stretching position by inserting shaft 188 of tool 190 into collar 178 with pins 182 aligned with slot 180 (FIGS. 1 and 11). Shaft 188 is then rotated by moving handle 192 through an arc to exert a torque on the shaft. Rotary movement of shaft 188 turns collar 178 and the barrel of worm gear 170. As the barrel rotates, helical groove 172 moves gear wheels 142, 166 in the directions of arrows 174, 176. Cable 140 is thereby wound around wheels 142, 166 to tighten cable 142 and lock the swingable portion 30 in the stretching position. Alternatively, the tool 190 can be used to crank the swingable portion 30 from a relaxed position into the stretching position. Using this method, the screen is locked as soon as the swingable portion 30 reaches the stretching position.

As the swingable portion 30 descends, tension is exerted, via the retainers, on the screen 12 to stretch it. A screen printing process can then be performed with the stretched screen locked in position.

When the screen printing process is completed, handle 192 is moved through an arc in a direction opposite the direction that was used to tighten the cable. The barrel of worm gear 170 then rotates in an opposite direction, as do gear wheels 142, 166. Tension on cable 140 is relaxed, allowing the swingable portion 30 to be moved out of the stretching position. As the swingable portion is moved out of the stretching position, the screen workpiece is relaxed and can then be removed from the frame by sliding the retainers 90–96 out of the slots 84.

Alternative Embodiment

Figure 12:
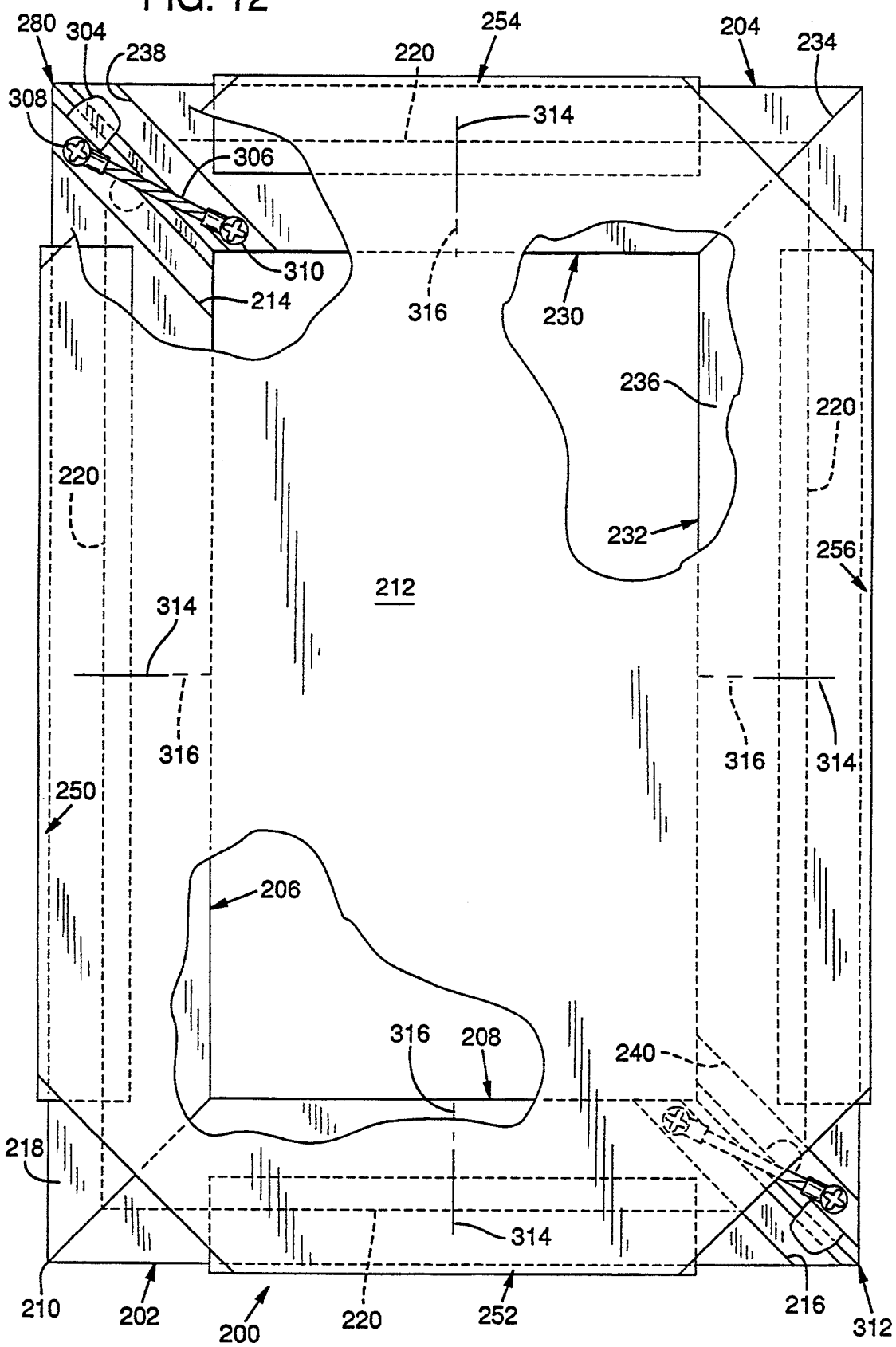
FIG. 12 is a top, plan view of an alternative embodiment of the invention frame, portions of the screen being broken away.
Figure 13:
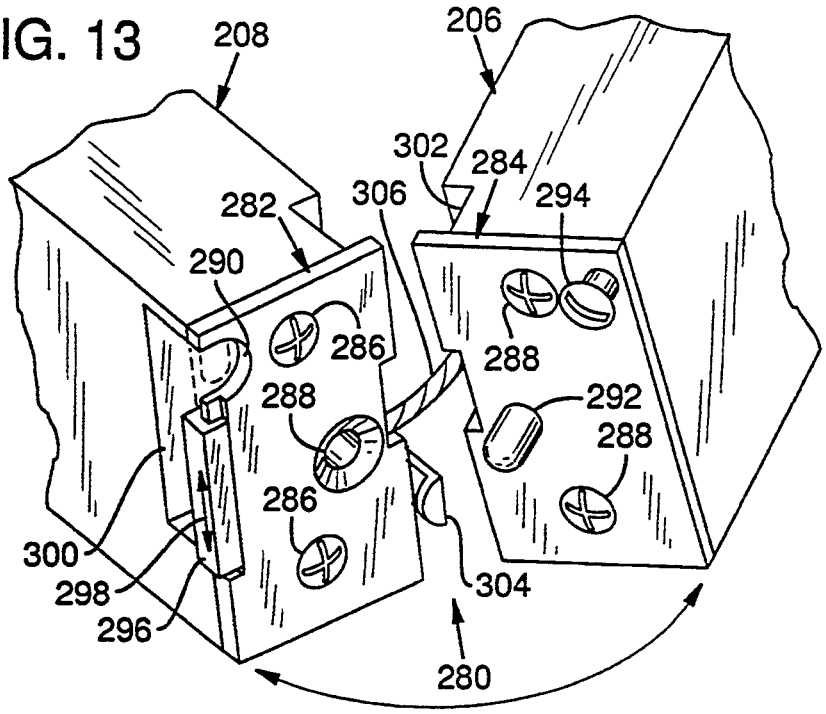
FIG. 13 is an enlarged, bottom, oblique view of one of the hinged connections of the frame of FIG. 12.
Figure 14:
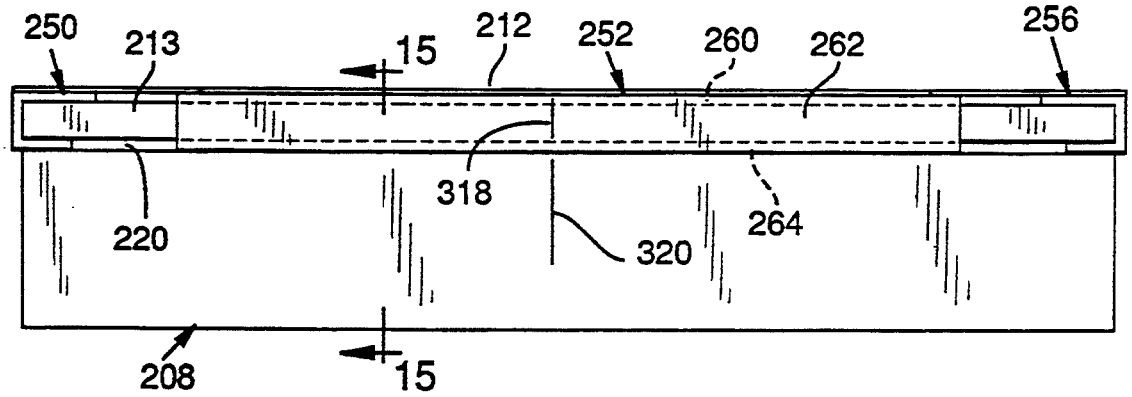
FIG. 14 is a side, elevational view of the frame shown in FIG. 12.

An alternative embodiment of the frame is shown in FIGS. 12–14. The frame 200 is similar to the frame 10 shown in FIGS. 1–11, except for the arrangement of the hinged connection between the movable and stationary parts of the frame, and the attachment of the retainers to the frame.

Figure 15:
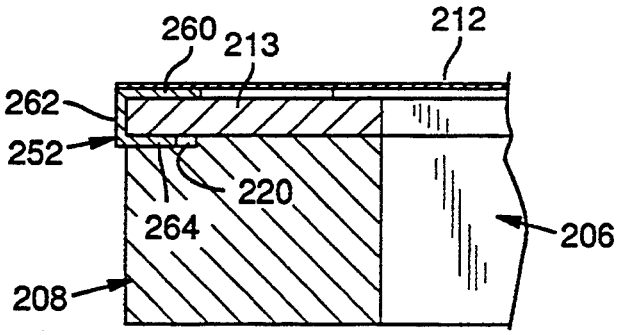
FIG. 15 is a partial, sectional view taken along line 15—15 of FIG. 14.

Frame 200 is a rectangular, frame having a stationary portion 202 and a movable portion 204. The stationary portion 202 includes legs 206, 208 that are made from a body of a material such as wood and are fixed to one another along a common mitered junction 210. Legs 206, 208 have a top surface member that defines a continuous top face. The top face is preferably provided by an L-shaped plastic surface member 213 (FIG. 14) that is adhered to the top faces of underlying legs 206, 208. The plastic surface member terminates along a slanted edge 214 at a distal end of leg 206 and a slanted edge 216 at a distal end of leg 208. The inner border of the retainer sits flush against a top surface of legs 206, 208, but the top surface of the legs is recessed downwardly along the outer border 218 of the frame such that there is a slot 220 between the retainer 213 and the underlying leg, such as leg 208 in FIG. 15.

Movable portion 204 of the frame 200 is similar to stationary portion 202, and includes legs 230, 232 that are fixed to one another along a mitered junction 234. An L-shaped surface member (such as surface member 213 in FIG. 14) extends continuously over the top surface of legs 230, 232 to provide a flat top face 236. The surface member terminates along inclined edges 238, 240 adjacent hinged connections between stationary and movable portions 202, 204 of frame 200. The outer border of legs 230, 232 is recessed to provide a peripheral slot between the surface member and the underlying frame.

Four retainers 250, 252, 254 and 256 are similar to the retainers 90, 92, 94 and 96 described in connection with FIGS. 1 and 4. Each retainer is similar to retainer 252 shown in FIG. 14, and includes a flat upper plate 260 adhered to a screen 212, a transverse spacer plate 262, and an inwardly projecting hook plate 264 that extends into the slot 220 between the surface member and frame to hook the retainer to the frame.

The distal ends of legs 206, 230 are joined along a hinged junction 280, that is shown in greater detail in FIG. 13. The hinged junction preferably includes a pair of metal plates 282, 284 that are fixed respectively to the end faces of legs 208, 206 by bolts 286, 288. Plate 282 contains a socket 288 and notch 290 for respectively receiving a dowel pin 292 and latch pin 294 that project perpendicularly outwardly from the outer surface of plate 284. A reciprocal latch 296 moves in the directions of arrow 298 in a recess 300 behind plate 282 to move a lock in and out of engagement with latch pin 294 when pin 294 is in place within notch 290 after plates 282, 284 are brought into abutment by closing frame 200. A slot 302 extends behind plate 284 such that a hook 304 that extends from the edge of plate 282 can hook over plate 284 and into notch 302 to help retain plates 282, 284 in alignment when the frame is in its stretching position. Finally, the opposite ends of a cable 306 are attached to the wooden frame by screws 308, 310. Cable 306 extends across junction 280 between terminal edges 214, 238 of the plastic members. This cable 306 helps maintain legs 206, 230 in substantial alignment when the hinged junction is in the unlocked orientation shown in FIG. 13.

Legs 208, 232 are similarly joined at a hinged connection 312 that is similar to the hinge connection 280 described above.

In operation, a printing screen is attached to retainers 250, 252, 254 and 256, as described in connection with the operation of frame 10 above. The hooking plates (such as plate 264 in FIG. 14) of the retainers are then inserted into the slots of the relaxed frame between the surface member and underlying wooden leg. Indicia 314 or 318 on the screen assembly are aligned with indicia 316 or 320 on the frame to insure proper positioning of the screen assembly.

Movable portion 204 of the frame is then pushed down toward the surface on which stationary base portion 202 is resting, to bring the opposed metal plates at hinged junctions 280, 312 into abutment with one another. The dowel pin 292 fits into socket 288, while latch pin 294 fits into socket 290 (FIG. 13). Hook 304 engages over the edge of plate 284, to further align plates 282, 284, and latch 296 is moved over the enlarged head of latch pin 294 in notch 290 to lock the legs perpendicular to one another in the orientation shown in FIG. 12. Screen printing can then proceed as described in connection with the previous embodiment.

When it is desired to change screens, latch 296 can be pulled away from latch pin 294 to free legs 206, 208 from one another and allow movable portion 204 to swing up away from the surface on which stationary portion 202 rests. Once movable portion 204 is moved into the relaxed position, the retainers can be removed from the frame, and the screen stored for subsequent use. A new screen can then be placed on the frame, and the procedure described above repeated to lock the screen taut on the frame for use.

Having illustrated and described the principles of the invention in two preferred embodiments, it should be apparent to those skilled in the art that the invention can be modified in arrangement and detail without departing from such principles. I claim all modifications coming within the spirit and scope of the following claims.

For example, although the locking mechanisms described above are unique, there are other mechanisms, such as removable pins or screws joining hinged legs, that would work in certain instances.

In the illustrated embodiments, uniform tension is achieved by using a workpiece that is narrowed near the centers of its edges and pulled to a substantially uniform tension and a substantially rectangular shape. A considerably less convenient way to achieve uniform tension would be to start with a truly rectangular workpiece and stretch it on a frame with the edges of the workpiece bowed outwardly at their centers (not shown) so as to stretch the workpiece a greater amount between the centers of two workpiece edges than between two adjacent corners of each edge. It is not absolutely necessary that the workpiece be even generally rectangular or have edges conforming to the retainers. The advantages of this workpiece system will be obtained so long as a greater amount of workpiece stretching occurs along the centerlines of the workpiece than along lines that are located outwardly of and that extend parallel to the centerlines.

Also, although spacers 90–96 and indicia 314–320 are discussed above, other alignment mechanisms can be used to achieve repeatable workpiece positioning.

It should also be understood that the workpiece can be something other than a printing screen. The systems described above can be used whenever it is necessary to tightly stretch a sheet of material. Some signs, for example, are printed on flexible plastic sheeting. Such sign sheeting can advantageously be dimensioned, mounted and/or stretched on a frame according to the present invention.

I claim:

1. A frame for stretching a planar workpiece, the frame having four bars arranged substantially as a rectangle and comprising:

a base portion defining a first plane in which the workpiece is stretched;

a swingable portion that pivots about a fold axis which extends diagonally with respect to the bars and that thus moves, relative to the base portion, from a relaxed position in which the swingable portion defines a plane that is not co-planar with the first plane, to a stretching position in which the swingable portion defines a plane that is substantially co-planar with the first plane;

a hinge assembly joining the base portion and swingable portion; and a device to secure four edge portions of a flexible planar workpiece along each bar respectively.

2. The frame of claim 1 wherein the workpiece is a screen.

3. The frame of claim 1 wherein:

the frame is quadrilateral;

the base and swingable portions each comprise an angled, two-legged member;

each two-legged member has a first and a second leg; and the frame further comprises a hinge joining the first legs and a hinge joining the second legs.

4. The frame of claim 3 wherein each hinge is mounted to rotate about an axis that extends through one of the angled members.

5. The frame of claim 4 further comprising, at a common mating end of the frame, a guide member of one of the two-legged members and a guide socket in the other of the two-legged members into which the guide member fits.

6. The frame of claim 1 further comprising a lock that maintains the swingable portion in the stretching position relative to the base portion.

7. The frame of claim 6 wherein the lock comprises a tensioning mechanism which is connected to the base portion and to the swingable portion and which, in use, pulls the swingable portion toward the first plane.

8. The frame of claim 7 wherein the lock comprises a cable extending through the frame and crossing at least one of the hinges.

9. The frame of claim 8 wherein the lock further comprises:

a plurality of pulleys spaced around the frame with the cable riding on the pulleys; and a tightener that selectively increases the tension on the cable.

10. The frame of claim 9 wherein the tightener comprises a worm gear.

11. The frame of claim 1 wherein the device comprises a plurality of elongated retainers each having a workpiece retaining portion and a frame engaging portion.

12. The frame of claim 11 wherein:

each portion of the frame has an outside face that defines an elongated slot;

each workpiece retaining portion has a planar surface to which an edge of the workpiece can be adhered; and each frame engaging portion comprises an L-shaped hook that fits over one of the outside faces and into a slot of that face.

13. The frame of claim 12 further comprising a body of adhesive securing the workpiece to the retaining member.

14. The frame of claim 12 further comprising a spacer that selectively fits against one of the retainers to inhibit longitudinal movement of that retainer toward the spacer.

15. The frame of claim 1 further comprising a four-cornered, four-sided workpiece having arcuate edges that curve such that the width and length of the workpiece are reduced toward the center of the workpiece.

16. The frame of claim 11 wherein:

each retainer has a long longitudinal free edge that extends parallel to a leg of the frame when the retainer is installed on the frame; and the workpiece is a printing screen adhered to the retainers with the arcuate edges conforming to the longitudinal free edges.

17. The frame of claim 1 wherein the bars are $1\frac{1}{4}$ inch square aluminum stock having a wall thickness of $\frac{1}{8}$ inch.

18. A rectangular frame for stretching a quadrilateral printing screen, comprising:

a right angle-shaped base portion defining a first plane;

a right angle-shaped swingable portion that pivots relative to the base portion and moves from a relaxed position in which the swingable portion defines a plane that is not co-planar with the first plane, to a stretching position in which the swingable portion defines a plane that is substantially co-planar with the first plane, the base portion comprising first and second legs having first and second distal ends respectively, the swingable portion comprising first and second legs having first and second distal ends respectively;

a first hinge between the first ends of the base and swingable portions, including a pivot attachment to the first end of the swingable portion that allows the first leg of the swingable portion to rotate about an axis that extends through the first leg of the swingable portion;

a second hinge between the second ends of the base and swingable portions, including a pivot attachment to the second end of the swingable portion that allows the second leg of the swingable portion to rotate about an axis that extends through the second leg of the swingable portion;

an elongated slot in an outer face of each leg of the frame;

four retainers for securing the screen to the frame, each retainer comprising a J-shaped member having a first planar flange for adhesively securing an edge of the screen to the retainer, and a spaced second planar flange that fits into one of the slots;

a spacer that selectively fits against each retainer to inhibit movement of the retainer in the slot toward the spacer;

a plurality of pulleys spaced around the interior of the frame, and a cable extending through the frame across the first and second hinges, the cable riding on the pulleys; and a tightener that selectively increases the tension on the cable.

19. The frame of claim 18 further comprising a quadrilateral screen having four edges, in which at least a portion of each of the four edges is adhered to the first planar flange of one of the retainers with a rectangular area of the screen overlapping the retainer, each of the four edges arcuately curving so that the length and width of the screen is reduced toward the center of the screen when the screen is not mounted on the frame.

20. A method of stretching a planar workpiece, comprising:

providing a frame comprising four bars arranged substantially as a rectangle, the frame having a base portion defining a first plane, a swingable portion that pivots relative to the base portion and moves from a relaxed position in which the swingable potion defines a plane that is not co-planar with the first plane to a stretching position in which the swingable portion defines a plane that is substantially co-planar with the first plane, and a hinge assembly that joins the base portion and swingable portion and that defines a fold axis which extends diagonally with respect to the bars;

respectively securing four edge portions of a workpiece along the four bars while the swingable portion is in the relaxed position; and then moving the swingable portion from the relaxed to the stretching position to stretch the workpiece.

21. The method of claim 20 further comprising the step of providing a screen as a workpiece.

22. The method of claim 21 further comprising the step of performing screen printing with the screen while the swingable portion is in the stretching position.

23. The method of claim 21 wherein:

the frame further comprises a cable crossing at least one hinge; and the method further comprises increasing tension on the cable to maintain the swingable portion in the stretching position.

24. The method of claim 21 wherein:

the step of providing the screen as a workpiece comprises providing a quadrilateral screen having four arcuate edges that curve such that the width and length of the screen is narrowed toward the center of the screen;

the step of providing a frame comprises providing a quadrilateral frame comprising four legs, each leg having a top face in the first plane when the swingable arm is in the stretching position and an outwardly facing side face that is perpendicular to the top face and defines an elongated slot; and the step of securing the edges of the screen to the frame comprises providing multiple retainers each of which includes first and second spaced planar flanges, and adhering each of the four edges of the screen to the first planar flange of one of the retainers, then inserting the second planar flange of each retainer into one of the slots.

25. The method of claim 21 wherein:

the step of providing the screen as a workpiece comprises providing a quadrilateral screen having four arcuate edges that curve such that the width and length of the screen is reduced toward the center of the screen;

the step of providing a frame comprises providing a quadrilateral frame comprising four legs; and the step of securing the edges of the screen to the frame comprises adhering peripheral margins of the screen to a plurality of retainers such that the arcuate edges of the screen are substantially linear when the screen is secured to the frame and the swingable portion is in the stretching position.

26. A method for providing a stretched planar workpiece, the method comprising:

providing a planar workpiece that is generally rectangular, but that, when the workpiece is not tensioned, has arcuate edges such that the width and length of the workpiece are less at the centerlines of the workpiece than at outlying regions of the workpiece;

providing a frame having surfaces that are adapted to engage the edges of the workpiece and that are movable to predetermined positions in a plane to exert outward forces on the workpiece at each of the edges;

securing the arcuate edges of the workpiece to the surfaces; and moving the surfaces to the predetermined positions in the plane in such a manner that the frame applies predetermined lateral and longitudinal tensile forces to the workpiece to stretch the workpiece to a predetermined tensioned configuration wherein (a) the edges are no longer arcuate, but instead have been straightened, and (b) opposite edges have been moved apart, so that the edges lie in a rectangle of predetermined dimensions.

27. The method of claim 26 further comprising the step of providing a screen as the workpiece.

28. The method of claim 26 wherein the step of securing the edges of the workpiece to the surfaces comprises:

providing a plurality of retainers, each retainer having a longitudinal edge;

adhering the workpiece to the retainers with the edges of the workpiece conforming to the edges of the retainers; and securing the retainers to the surfaces.

29. A printing screen that is generally in the shape of a rectangle and that is adapted for mounting on a rectangular frame, the screen:

having two longitudinal edges, two lateral edges, a longitudinal centerline ($C_1$), and a lateral centerline ($C_2$) that is perpendicular to the longitudinal centerline ($C_1$);

having, between the lateral edges, a length (l) measured along lines parallel to a centerline ($C_1$), the length (l) being progressively greater as distance away from the centerline ($C_1$) increases, the measurements being made when the sheet lies flat and nontensioned;

having, between the longitudinal edges, a width measured along lines parallel to a centerline ($C_2$), the width (w) being progressively greater as distance away from the centerline ($C_2$) increases, the measurements being made when the sheet lies flat and nontensioned; and being of a predetermined size and shape such that, when the screen is uniformly tensioned on a frame, the edges lie in a rectangle of predetermined dimensions.

30. The printing screen of claim 29 further comprising four elongate retainers attached to the screen, one retainer extending along and conforming to each edge.

31. The printing screen of claim 29 wherein each edge is a minor arc of a circle.

32. A printing screen that is generally in the shape of a rectangle having two longitudinal edges, two lateral edges, a longitudinal centerline and a lateral centerline, the edges being arcs shaped such that, when the screen is not tensioned, the width and length of the screen are less when measured along the centerlines than when measured at locations outwardly of the centerlines and such that, when sufficient longitudinal and lateral tensile forces are applied by a frame to hold the edges straight, the screen is uniformly tensioned.

33. A planar workpiece system comprising:

a workpiece that includes a sheet of planar material and four elongated retainers that are separately and permanently attached to the sheet and are arranged in a predetermined pattern generally in the shape of a rectangle of predetermined dimensions, the workpiece having a longitudinal centerline that extends parallel to and is equidistant from two of the retainers, and a lateral centerline that extends parallel to and is equidistant from the other two of the retainers; and a frame having four surfaces that are adapted to releasably engage the four retainers respectively and that are movable to predetermined positions in a plane to exert an outward force on each of the retainers, the relative spacings of opposed retainers and surfaces being such that the length (L) of the frame measured between the surfaces that engage opposed retainers of the workpiece along a centerline ($C_1$) is greater than the length (l) of the workpiece measured between the retainers along the corresponding centerline ($C_1$) of the workpiece when the workpiece lies flat and relaxed, the difference between the lengths (L) and (l) being greatest along the centerlines ($C_1$) and being progressively less, as measured along lines parallel to the centerlines ($C_1$), as distance away from the centerlines ($C_1$) increases.

34. The system of claim 33 comprising multiple, interchangeable workpieces.

35. A method of supporting a planar workpiece on a frame having movable leg portions, the method comprising:

providing a non-tensioned sheet of planar material on which is indicated a geometric Figure of predetermined dimensions generally in the shape of a rectangle having four edges, a longitudinal centerline and a lateral centerline;

providing a separate frame having movable leg portions which are adapted to move to a predefined position wherein the frame is generally rectangular, each leg portion having an edge, at least one of (a) the geometric Figure and (b) the frame having edges that are not straight but instead are shaped such that the length (L) between opposite edges of the frame measured along a centerline ($C_1$) is greater than the length (l) between opposite edges of the geometric Figure measured along the corresponding centerline ($C_1$) of the sheet, the difference between the lengths (L) and (l) being greatest along the centerlines ($C_1$) and being progressively less, as measured along lines parallel to the centerlines ($C_1$), as distance away from the centerlines ($C_1$) increases, the measurements being made when the sheet lies flat and non-tensioned and the leg portions are in the predefined position wherein the frame is generally rectangular;

attaching the non-tensioned sheet to the frame with the four edges of the geometric Figure respectively aligned with the edges of the frame; and moving the leg portions to predetermined positions in a plane wherein the edges of the frame are arranged generally in a rectangle and the frame applies predetermined tensile forces to the sheet and stretches the sheet to a tensioned configuration where the edges of the geometric Figure conform to the corresponding edges of the frame.

36. A planar workpiece system comprising:

a piece of screen printing fabric;

four elongated retainers that are attached to the fabric along the perimeter of a geometric Figure generally in the shape of a rectangle; and a frame having four frame surfaces that are adapted to releasably receive each of the retainers respectively and that are movable between (a) first positions wherein the frame surfaces do not exert outward force on the retainers so that the retainers can be mounted on or removed from the frame surfaces and (b) second positions which are predetermined in a common plane and wherein the frame surfaces exert an outward force on each of the retainers to tension the fabric, the frame surfaces being shaped to allow longitudinal movement of the retainers such that the retainers can slide longitudinally along the frame surfaces when the frame surfaces are in the first positions and the retainers are mounted such that the retainers abut the frame surfaces;

wherein at least one of (a) the geometric Figure and (b) the frame surfaces have edges that are not straight but instead are shaped such that the length (L) of the frame measured between the frame surfaces along a centerline ($C_1$) is greater than the length (l) of the geometric Figure measured along the corresponding centerline ($C_1$) of the fabric, the difference between the lengths (L) and (l) being greatest along the centerlines ($C_1$) and being progressively less, as measured along lines parallel to the centerlines ($C_1$), as distance away from the centerlines ($C_1$) increases, the measurements being made (a) before the retainers are attached to the fabric, (b) while the fabric lies flat and non-tensioned, and (c) while the surfaces are in the second positions.

* * * * *